US008306454B2

(12) United States Patent
Kinoshita

(10) Patent No.: US 8,306,454 B2
(45) Date of Patent: Nov. 6, 2012

(54) IMAGE FORMING APPARATUS WITH IMPROVED ACCURACY IN FORMING A GAP BETWEEN A DEVELOPING UNIT AND A PHOTORECEPTOR DRUM

(75) Inventor: Takeru Kinoshita, Toyokawa (JP)

(73) Assignee: Konica Minolta Business Technologies, Inc., Tokyo (JP)

( * ) Notice: Subject to any disclaimer, the term of this patent is extended or adjusted under 35 U.S.C. 154(b) by 351 days.

(21) Appl. No.: 12/631,525

(22) Filed: Dec. 4, 2009

(65) Prior Publication Data

US 2010/0142994 A1 Jun. 10, 2010

(30) Foreign Application Priority Data

Dec. 5, 2008 (JP) ..... 2008-310818

(51) Int. Cl.
*G03G 21/18* (2006.01)
*G03G 15/04* (2006.01)

(52) U.S. Cl. ..... 399/113; 399/119

(58) Field of Classification Search ..... 399/111, 399/119, 228, 113, 116
See application file for complete search history.

(56) References Cited

U.S. PATENT DOCUMENTS

| | | | | |
|---|---|---|---|---|
| 4,740,767 | A * | 4/1988 | Kawano et al. | 399/119 |
| 4,851,873 | A * | 7/1989 | Sakao et al. | 399/119 |
| 4,896,193 | A * | 1/1990 | Kagiura et al. | 399/110 |
| 5,068,691 | A * | 11/1991 | Nishio et al. | 399/284 |
| 7,463,844 | B2 * | 12/2008 | Hashimoto et al. | 399/111 |
| 7,962,065 | B2 | 6/2011 | Ukai | |

FOREIGN PATENT DOCUMENTS

| | | |
|---|---|---|
| JP | 62-96661 | 6/1987 |
| JP | 11-38760 | 2/1999 |
| JP | 2002-174952 A | 6/2002 |
| JP | 2003-262996 | 9/2003 |
| JP | 2004-252255 | 9/2004 |
| JP | 2004-264791 | 9/2004 |
| JP | 2005-91582 A | 4/2005 |
| JP | 2008-46549 | 2/2006 |
| JP | 2006-91582 | 4/2006 |
| JP | 2006-129720 | 5/2006 |
| JP | 2006-139226 | 6/2006 |
| JP | 2006-337413 | 12/2006 |
| JP | 2008-44730 | 2/2008 |

OTHER PUBLICATIONS

Japanese Decision to Grant Patent mailed Jun. 28, 2011, directed to counterpart Japanese Patent Application No. 2008-310818; 6 pages.
Japanese Notice of Grounds of Rejection mailed on Oct. 19, 2010, directed to counterpart Japanese Patent Application No. 2008-310818; 6 pages.

* cited by examiner

*Primary Examiner* — Robert Beatty
(74) *Attorney, Agent, or Firm* — Morrison & Foerster LLP

(57) ABSTRACT

An image forming apparatus includes: a photoreceptor unit having a photoreceptor drum on which an electrostatic latent image is formed; a developing unit for developing the electrostatic latent image formed on the photoreceptor drum; a developing unit supporting shaft for rotatably supporting the developing unit; a pressing lever for pushing and rotating the developing unit to press the developing unit against the photoreceptor unit; a rotatable pressing lever shaft for supporting the pressing lever; and a holding member for holding the developing unit supporting shaft and the pressing lever shaft to maintain a fixed distance between the developing unit supporting shaft and the pressing lever shaft.

8 Claims, 14 Drawing Sheets

IMAGE FORMING APPARATUS WITH IMPROVED ACCURACY IN FORMING A GAP BETWEEN A DEVELOPING UNIT AND A PHOTORECEPTOR DRUM

This application is based on Japanese Patent Application No. 2008-310818 filed with the Japan Patent Office on Dec. 5, 2008, the entire content of which is hereby incorporated by reference.

BACKGROUND OF THE INVENTION

1. Field of the Invention

The present invention relates to an image forming apparatus, in particular, an image forming apparatus having a structure for pressing a developing unit against a photoreceptor unit.

2. Description of the Related Art

Japanese Laid-Open Patent Publication No. 2004-252255 (Document 1) describes an image forming apparatus having a structure for inserting a developing unit along a rail biased by a spring member, engaging therein, and positioning the rail at a reference position to allow a predetermined gap to be maintained between a photoreceptor drum and a developing roller.

Japanese Laid-Open Patent Publication No. 2006-337413 (Document 2) describes an image forming apparatus having a first frame for supporting a photoreceptor drum, and a second frame for supporting a developing roller. In the image forming apparatus, a cam is used to rotate the second frame between a location at which the developing roller makes contact with the photoreceptor drum and a location at which the developing roller is separated from the photoreceptor drum.

In each of the image forming apparatuses described in Documents 1, 2, accuracy in the gap is not necessarily sufficient between the photoreceptor drum and the developing roller due to the following reasons.

In the image forming apparatus described in Document 1, the developing unit is "displaced" on the rail, which changes the biasing force provided from the spring member, thus resulting in a less accurate gap between the photoreceptor drum and the developing roller.

In the image forming apparatus described in Document 2, the frame pushed by the cam is "displaced", thus resulting in a less accurate gap between the photoreceptor drum and the developing roller.

The above-described unfixed gap between the developing roller and the photoreceptor drum can cause problems such as decreased image density and uneven image density.

SUMMARY OF THE INVENTION

An object of the present invention is to provide an image forming apparatus allowing for a highly accurate gap between a developing unit and a photoreceptor drum.

In one aspect, an image forming apparatus according to the present invention includes: a photoreceptor unit having a photoreceptor drum on which an electrostatic latent image is formed; a developing unit for developing the electrostatic latent image formed on the photoreceptor drum; a first shaft for rotatably supporting the developing unit; a lever member for pushing and rotating the developing unit to press the developing unit against the photoreceptor unit; a rotatable second shaft for supporting the lever member; and a holding member for holding the first shaft and the second shaft to maintain a fixed distance between the first shaft and the second shaft.

In one embodiment, in the image forming apparatus, the holding member is provided in a location next to the lever member.

In one embodiment, the image forming apparatus further includes a body frame for holding the first shaft and the second shaft. The holding member is fixed to the body frame.

In one embodiment, in the image forming apparatus, one end of the first shaft is a free end.

In one embodiment, the image forming apparatus further includes a pushing unit, which is attached to the second shaft and is capable of pushing the photoreceptor unit in an axial direction. The image forming apparatus is configured such that the lever member pushes and presses the developing unit against the photoreceptor unit in conjunction with the pushing unit pushing the photoreceptor unit.

In one embodiment, in the image forming apparatus, the holding member is provided only at a side at which a driving device for the developing unit is provided.

In another aspect, an image forming apparatus according to the present invention includes: a body frame having a first frame and a second frame; a photoreceptor unit having a photoreceptor drum on which an electrostatic latent image is formed; a developing unit, inserted into the body frame in a direction from the first frame toward the second frame and positioned next to the photoreceptor unit, for developing the electrostatic latent image formed on the photoreceptor drum; a first shaft, having one end fixed to the second frame and the other end that is a free end, and engaged with the developing unit inserted into the body frame, for rotatably supporting the developing unit; a second shaft, extending in the direction from the first frame toward the second frame and provided rotatably on the body frame; a lever member, fixed to the second shaft, for pushing the developing unit toward the photoreceptor unit in response to rotation of the second shaft; and a holding member for connecting the first shaft and the second shaft, the lever member being positioned between the holding member and the second frame.

In one embodiment, in the image forming apparatus, the photoreceptor unit is detachably inserted into the body frame in the direction from the first frame toward the second frame, and in the direction in which the photoreceptor unit is inserted, a lever unit, which is rotatable with said second shaft, is provided at an end of said second shaft closer to said first frame, the lever unit pushes the photoreceptor unit and fixes a position thereof in the direction in which the photoreceptor unit is inserted, by rotating the lever unit.

According to the present invention, the image forming apparatus achieves improved accuracy in the gap between the developing unit and the photoreceptor drum. More specifically, it is explained as follows.

In the structure employing the lever member to press the developing unit against the photoreceptor unit, the holding member is provided to maintain a fixed interval between the first shaft, which serves as a rotation supporting shaft for the developing unit, and the second shaft, which serves as a rotation supporting shaft for the lever member. In this way, forces acting on the first shaft and the second shaft can be canceled by each other when the developing unit is pressed against the photoreceptor unit. This can prevent the acting forces from displacing the first shaft and the second shaft. As a result, the photoreceptor unit and the developing unit can be positioned accurately, thus defining a gap between the developing unit and the photoreceptor drum accurately.

The foregoing and other objects, features, aspects and advantages of the present invention will become more apparent from the following detailed description of the present invention when taken in conjunction with the accompanying drawings.

DESCRIPTION OF THE PREFERRED EMBODIMENTS

Figure 1:
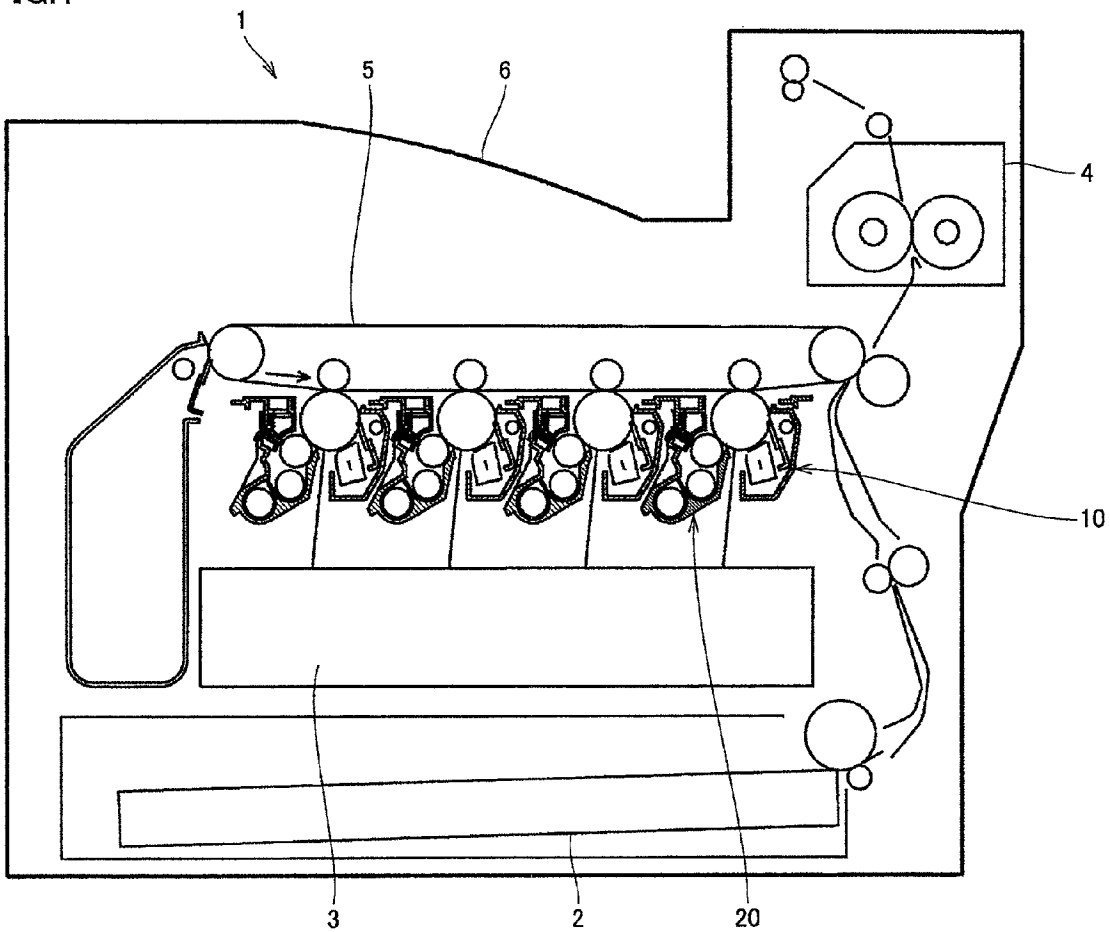
FIG. 1 shows an entire configuration of an image forming apparatus according to one embodiment of the present invention.

Embodiment of the present invention will be described below. It should be noted that the same or equivalent portions are given the same reference characters and may not be described repeatedly.

It should be also noted that the scope of the present invention is not necessarily limited to the number, amount, and the like described in the embodiment described below, unless otherwise noted. Furthermore, in the embodiment below, each component is not necessarily required in the present invention unless otherwise noted.

FIG. 1 is a diagram showing the entire configuration of an image forming apparatus according to one embodiment of the present invention. Referring to FIG. 1, image forming apparatus 1 corresponds to, for example, a copier, a printer, a facsimile machine and the like, and serves to form a predetermined image on a sheet of paper 2.

Image forming apparatus 1 includes an exposure unit 3, a fixing unit 4, a transfer belt 5, and a paper discharge tray 6. Furthermore, image forming apparatus 1 includes a photoreceptor unit 10 and a developing unit 20.

On a photoreceptor drum (not shown in FIG. 1) in photoreceptor unit 10, an electrostatic latent image having a desired pattern is formed by exposure unit 3. Developing unit 20, which is disposed facing photoreceptor unit 10, supplies toner onto the photoreceptor drum to develop the above-mentioned electrostatic latent image. Thus, a toner image having a desired pattern is formed on the photoreceptor drum by developing unit 20.

The toner images on their respective photoreceptor drums are sequentially transferred and superimposed on transfer belt 5, and collectively re-transferred onto the conveyed sheet of paper 2. The toner image transferred onto sheet of paper 2 is fixed in fixing unit 4. Sheet of paper 2 is then discharged onto paper discharge tray 6. Thus, the image having a desired pattern is formed on sheet of paper 2.

Figure 2:
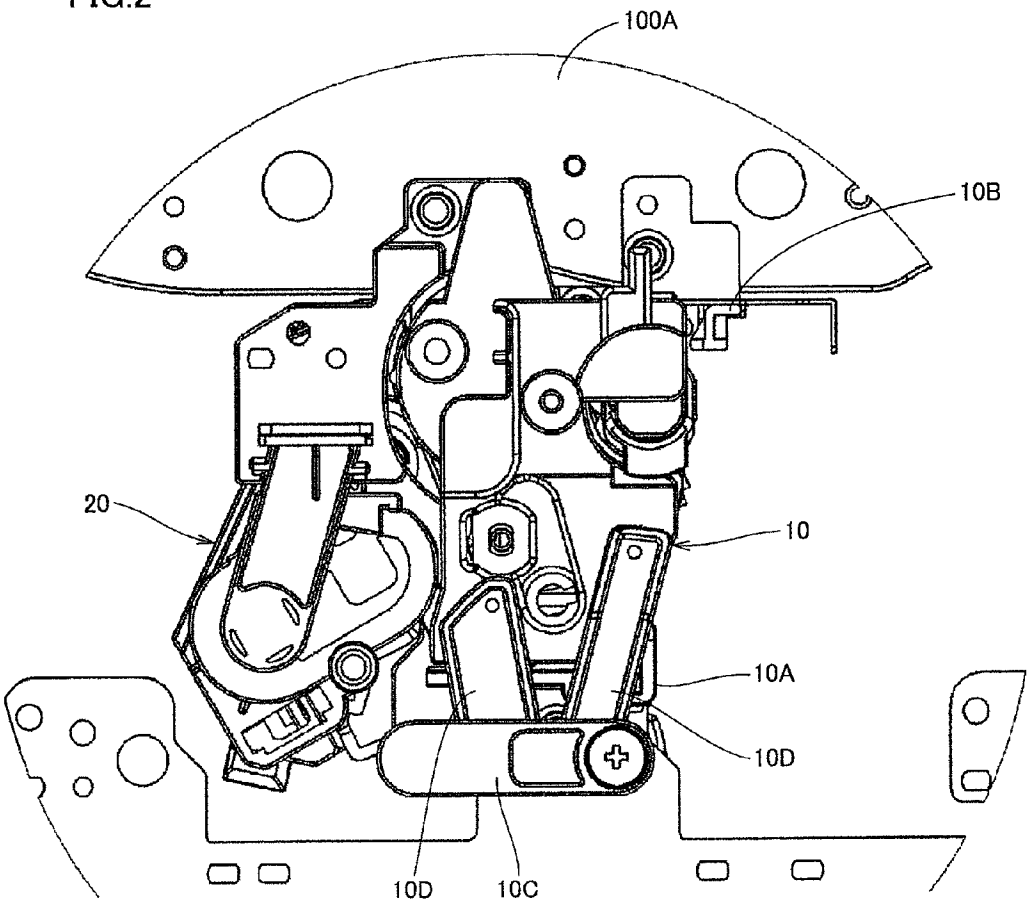
FIG. 2 is a first diagram showing a state in which a photoreceptor unit is attached in the image forming apparatus according to the embodiment of the present invention.
Figure 3:
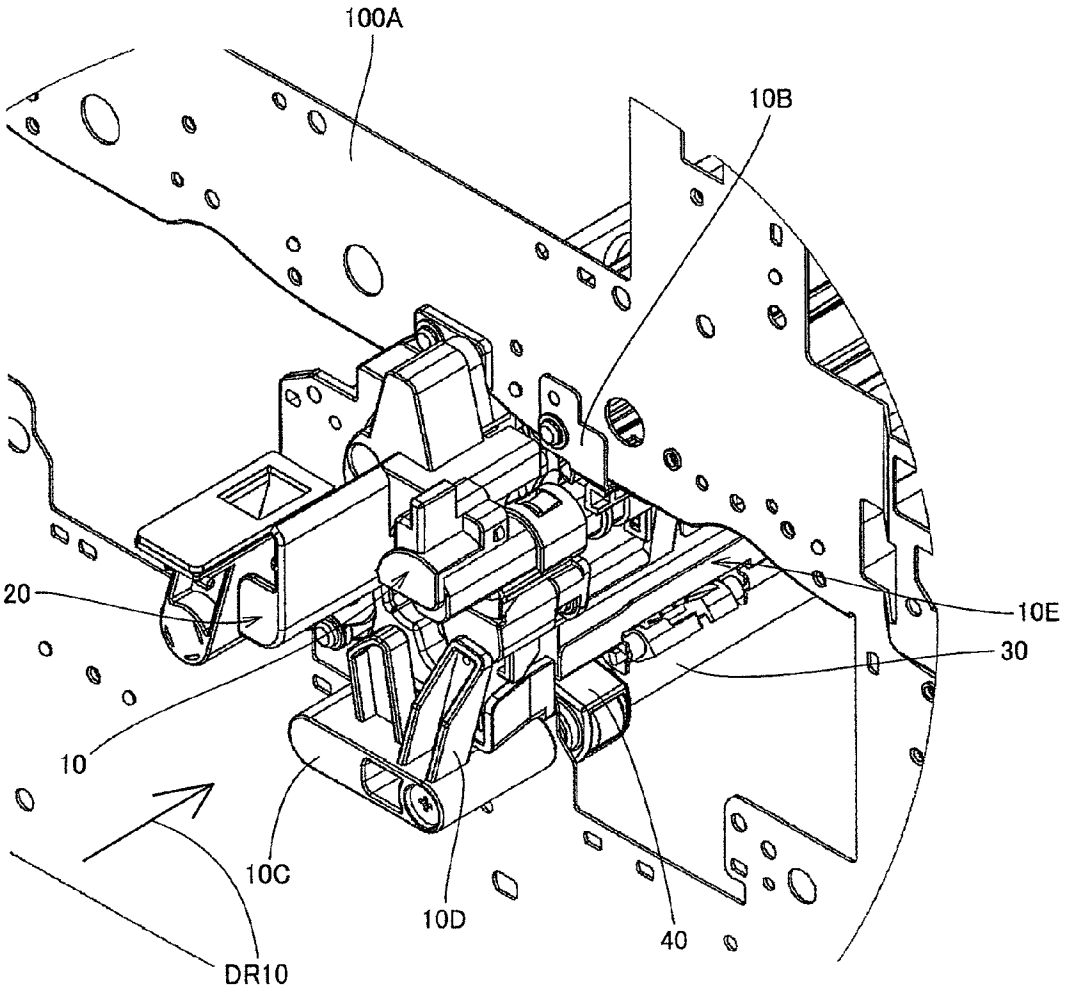
FIG. 3 is a second diagram showing the state in which the photoreceptor unit is attached in the image forming apparatus according to the embodiment of the present invention.
Figure 4:
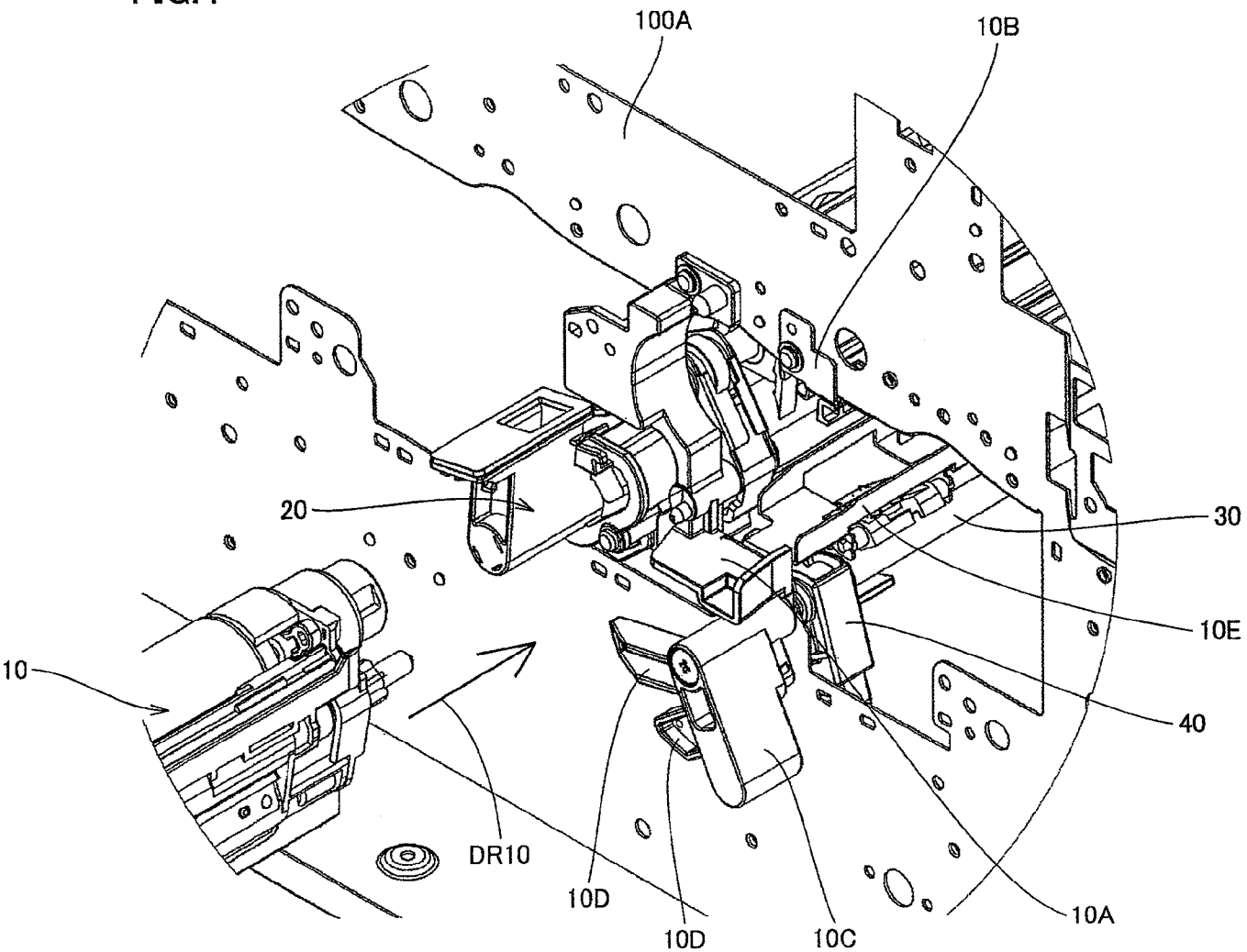
FIG. 4 shows a state before the photoreceptor unit is attached in the image forming apparatus according to the embodiment of the present invention.

FIGS. 2 and 3 show a state in which photoreceptor unit 10 is attached in image forming apparatus 1. FIG. 4 shows a state before photoreceptor unit 10 is attached in image forming apparatus 1. Referring to FIGS. 2-4, from a side external to a body frame 100A (first frame), photoreceptor unit 10 is inserted into the body frame along the direction indicated by an arrow DR10 (see FIG. 4). The insertion of photoreceptor unit 10 into the body frame is guided by insertion guides 10A, 10B, and a guide member 10E.

In addition, image forming apparatus 1 has a photoreceptor unit attaching lever 10C and a pushing unit 10D (lever unit). Photoreceptor unit attaching lever 10C and pushing unit 10D are attached to a pressing lever shaft 30 (hereinafter, also simply referred to as "shaft 30"), and rotate about shaft 30, which serves as a rotation axis. Shaft 30 is rotatably supported by the body frame. After inserting photoreceptor unit 10 into body frame 100A, photoreceptor unit attaching lever 10C and pushing unit 10D are rotated. As a result, pushing unit 10D pushes photoreceptor unit 10 in the axial direction (see FIGS. 2 and 3). In this way, photoreceptor unit 10 is held in the body frame.

To shaft 30, pressing levers 40 are attached. Each pressing lever 40 rotates around shaft 30, which serves as a rotation axis. Specifically, pressing lever 40 rotates in conjunction with photoreceptor unit attaching lever 10C and pushing unit 10D. By rotating pressing lever 40 from the state shown in FIG. 4 (state before photoreceptor unit 10 is attached) to the state shown in FIG. 3 (state after photoreceptor unit 10 is attached), developing unit 20 is pushed toward photoreceptor unit 10.

In other words, image forming apparatus 1 is configured so that, in conjunction with pushing unit 10D pushing photoreceptor unit 10, pressing lever 40 pushes and presses developing unit 20 against photoreceptor unit 10.

Figure 5:
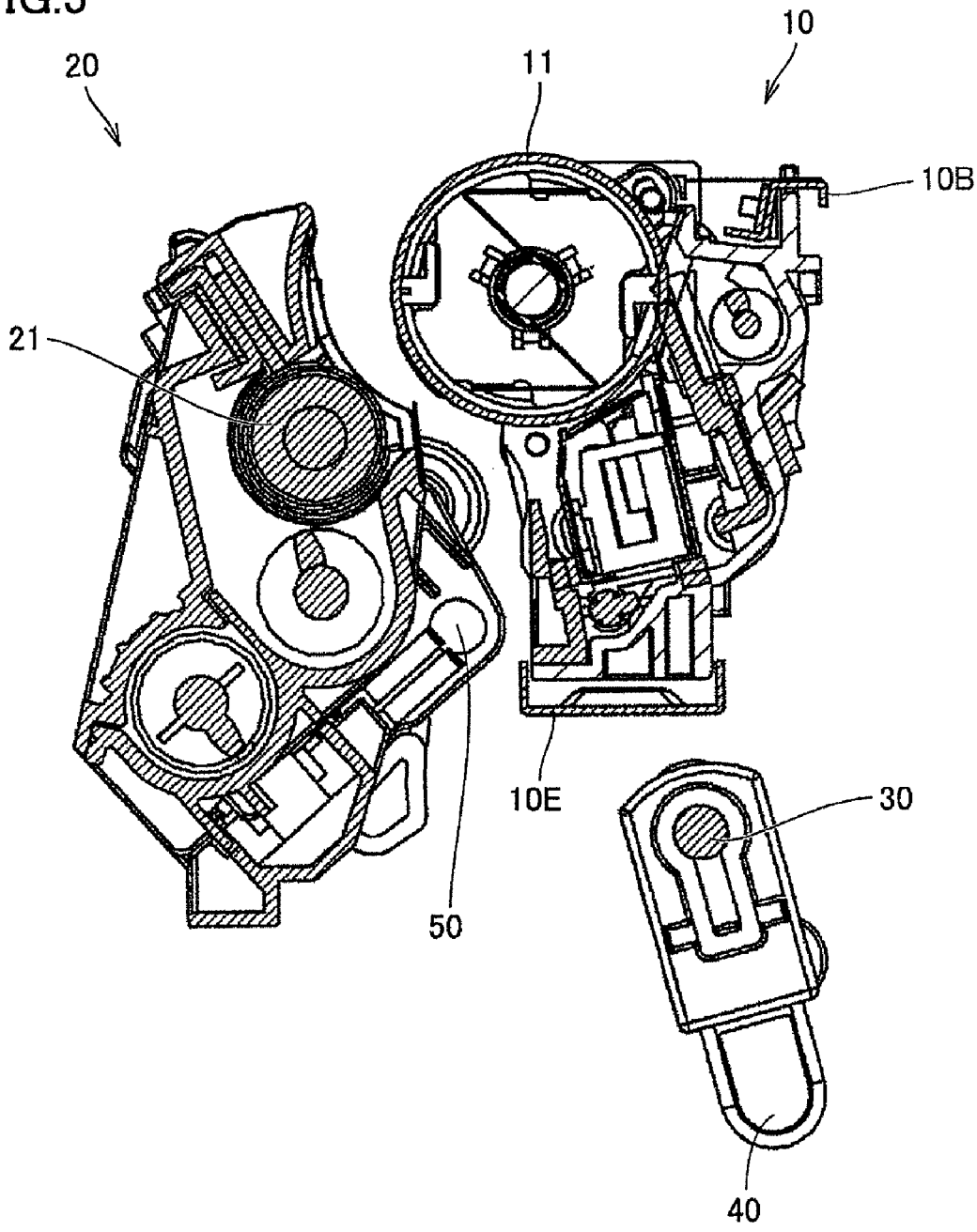
FIG. 5 shows a state after the photoreceptor unit is attached, in the image forming apparatus according to the embodiment of the present invention, and before a developing unit is pressed against the photoreceptor unit.
Figure 6:
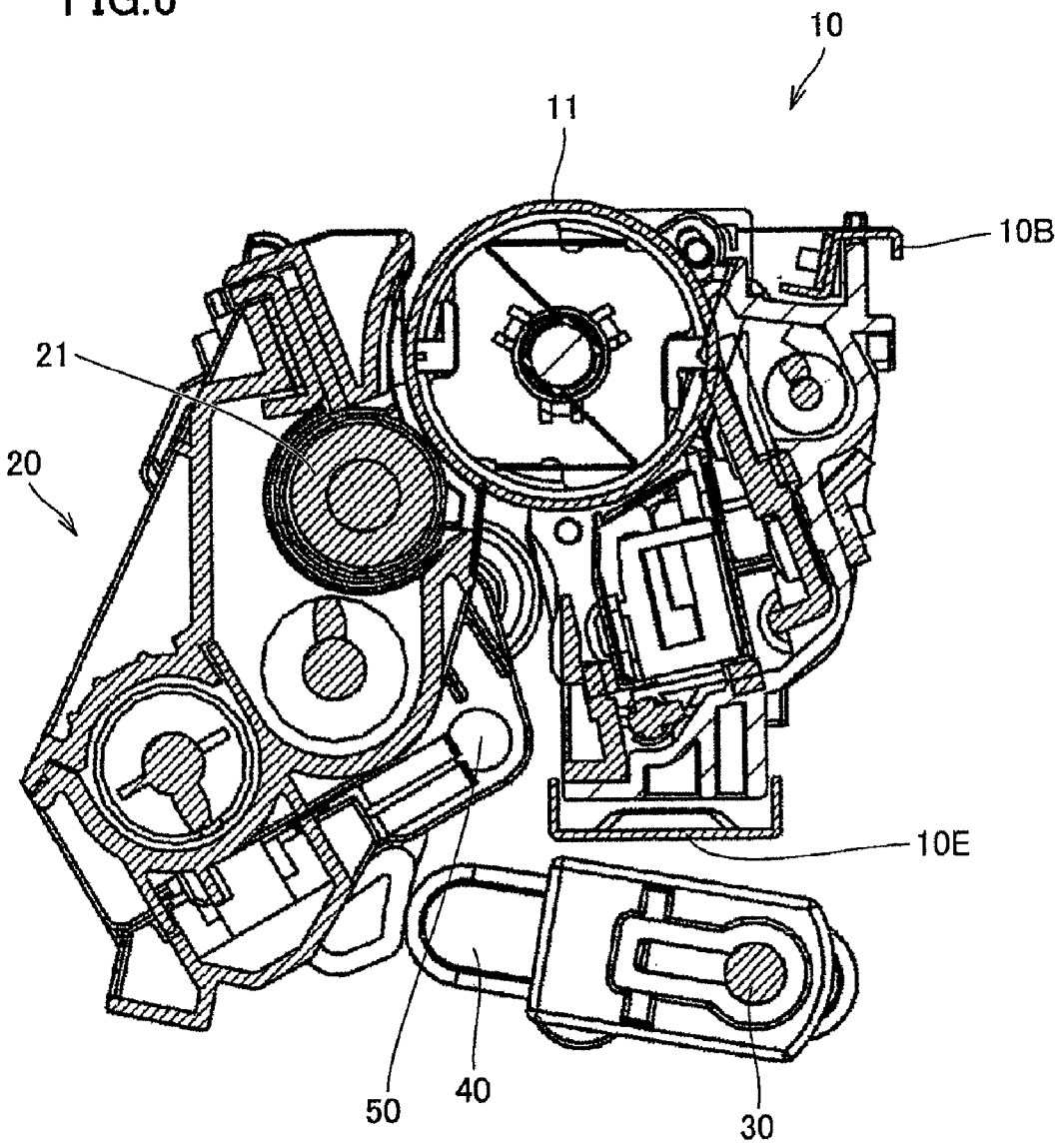
FIG. 6 shows a state after the developing unit is pressed against the photoreceptor unit in the image forming apparatus according to the embodiment of the present invention.

FIG. 5 shows a state after photoreceptor unit 10 is attached, in image forming apparatus 1, and before developing unit 20 is pressed against photoreceptor unit 10. FIG. 6 shows a state after developing unit 20 is pressed against photoreceptor unit 10.

Referring to FIGS. 5 and 6, after the insertion of photoreceptor unit 10 to the body frame, photoreceptor unit attaching lever 10C is rotated, thereby rotating pressing lever 40 toward developing unit 20 about shaft 30 serving as a rotation axis. As a result, developing unit 20 is pushed.

Developing unit 20 thus pushed by pressing lever 40 rotates about developing unit supporting shaft 50 (hereinafter, also simply referred to as "shaft 50") serving as a rotation axis. This causes a transition from the state in which photoreceptor drum 11 of photoreceptor unit 10 and developing roller 21 of developing unit 20 are separated from each other (state shown in FIG. 5) to the state in which they are in close contact with each other (state shown in FIG. 6).

Figure 7:
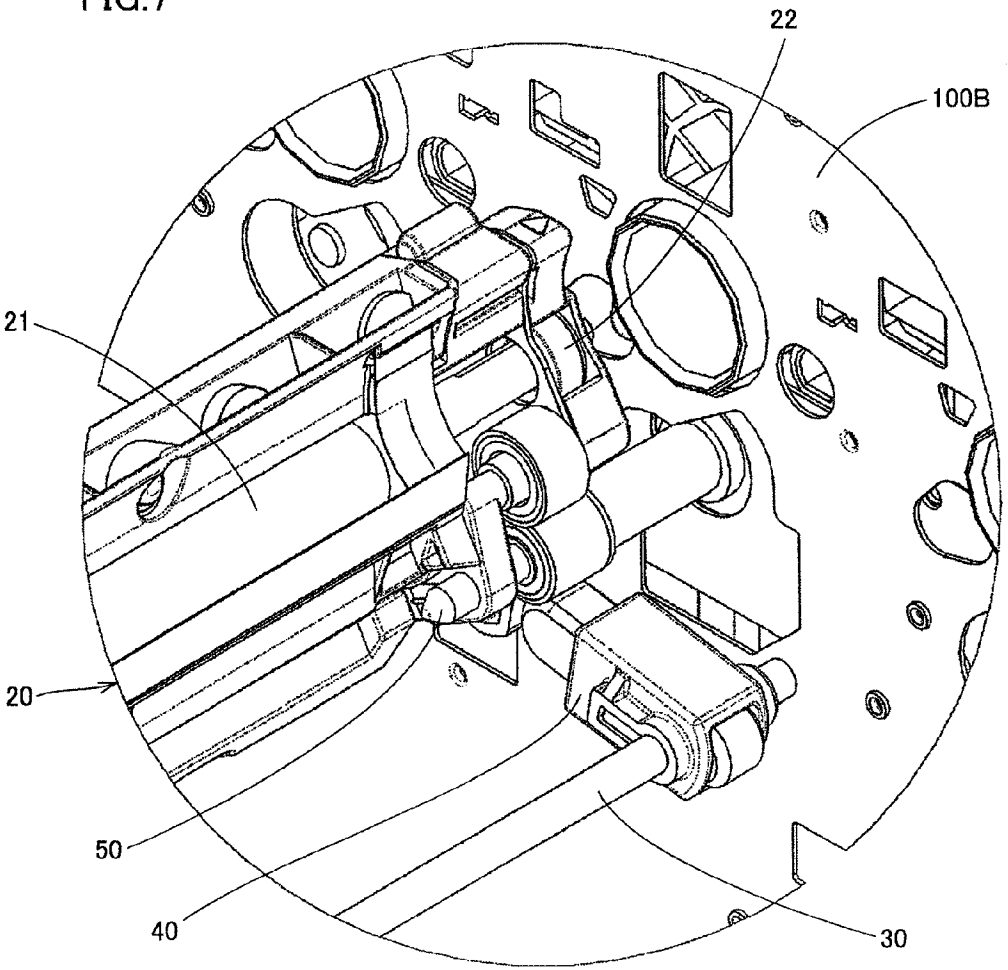
FIGS. 7 and 8 are illustrative diagrams each showing the configuration of the developing unit in the image forming apparatus according to the embodiment of the present invention.
Figure 8:
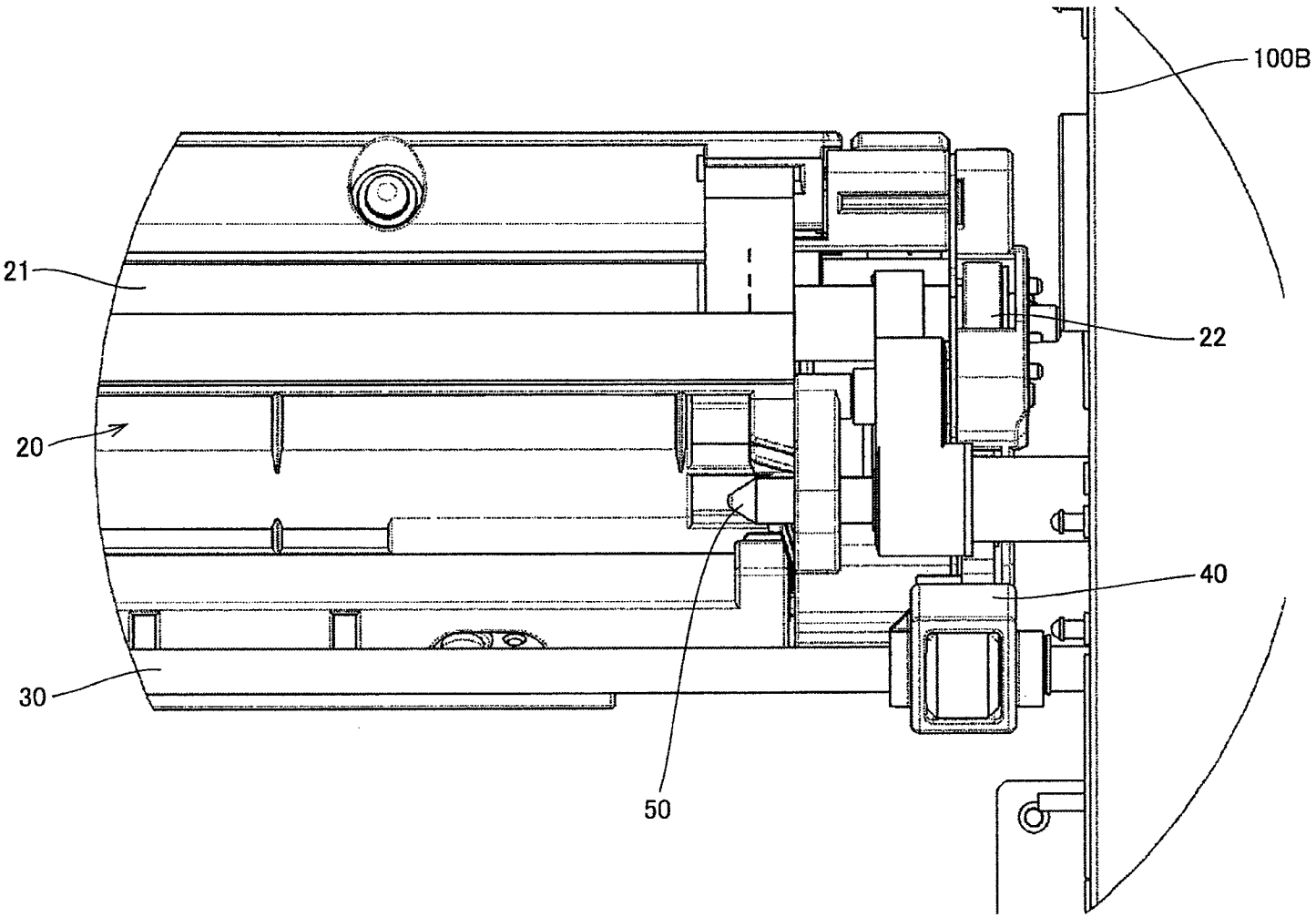

Next, a configuration of developing unit 20 in image forming apparatus 1 will be described with reference to FIGS. 7 and 8. As shown in FIGS. 7 and 8, developing unit 20 includes a roller member 22. Roller member 22 abuts on photoreceptor unit 10, whereby photoreceptor drum 11 and developing roller 21 are held with a predetermined gap maintained therebetween.

It should be noted that one end of shaft 50 serving as the rotation axis of developing unit 20 is a free end. In other words, shaft 50 has a cantilever structure in which only the other end thereof is supported by the body frame.

Figure 9:
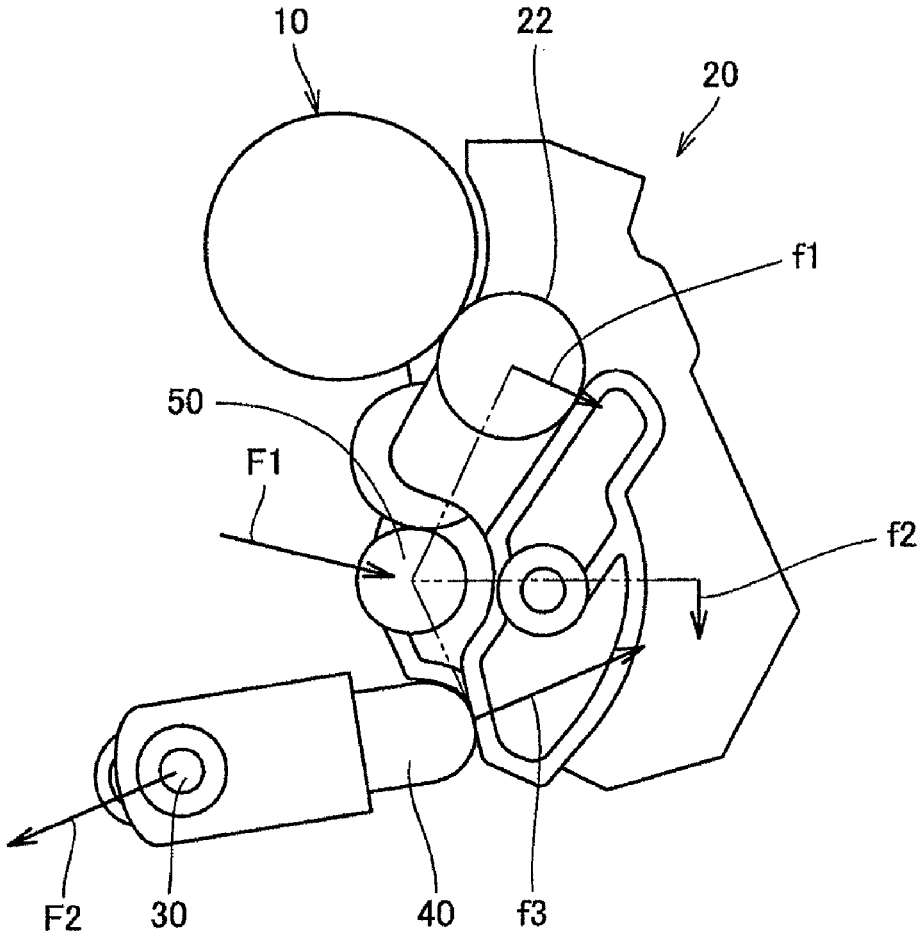
FIG. 9 is an illustrative diagram showing forces acting when the developing unit is pressed against the photoreceptor unit in the image forming apparatus according to the embodiment of the present invention.

With reference to FIG. 9 now, the following describes forces acting when developing unit 20 is pressed against photoreceptor unit 10 in image forming apparatus 1.

Referring to FIG. 9, when developing unit 20 abuts on photoreceptor unit 10, counteracting force (f1) received by roller member 22 from photoreceptor unit 10, the weight (f2) of developing unit 20, and pushing force (f3) received from pressing lever 40 act on developing unit 20. Accordingly, resultant force (F1) of forces f1, f2, f3 acts on shaft 50 supporting developing unit 20. This may cause deflection in shaft 50 ("inclination of shaft 50"). Similarly, since shaft 30 supporting pressing lever 40 receives counteracting force F2, deflection also may occur therein. Here, the direction of force F1 acting on shaft 50 and the direction of force F2 acting on shaft 30 are substantially opposite to each other. If deflections occur in shafts 50 and shaft 30 due to such forces F1, F2 acting thereon, the force for pressing developing unit 20 against photoreceptor unit 10 is decreased accordingly. This varies a gap at a portion in which photoreceptor drum 11 and developing roller 21 face each other. Such an unfixed gap between photoreceptor drum 11 and developing roller 21 is likely to cause problems such as decreased image density and uneven density. In the present embodiment, one end of shaft 50 is a free end and deflection is therefore likely to occur therein. Hence, it is particularly important to prevent inclination of shaft 50.

As a countermeasure to avoid the above-described problem, image forming apparatus 1 according to the present embodiment is provided with an inclination preventing mechanism for preventing inclination of shaft 50. This mechanism will be described below with reference to FIGS. 10 and 11.

Figure 10:
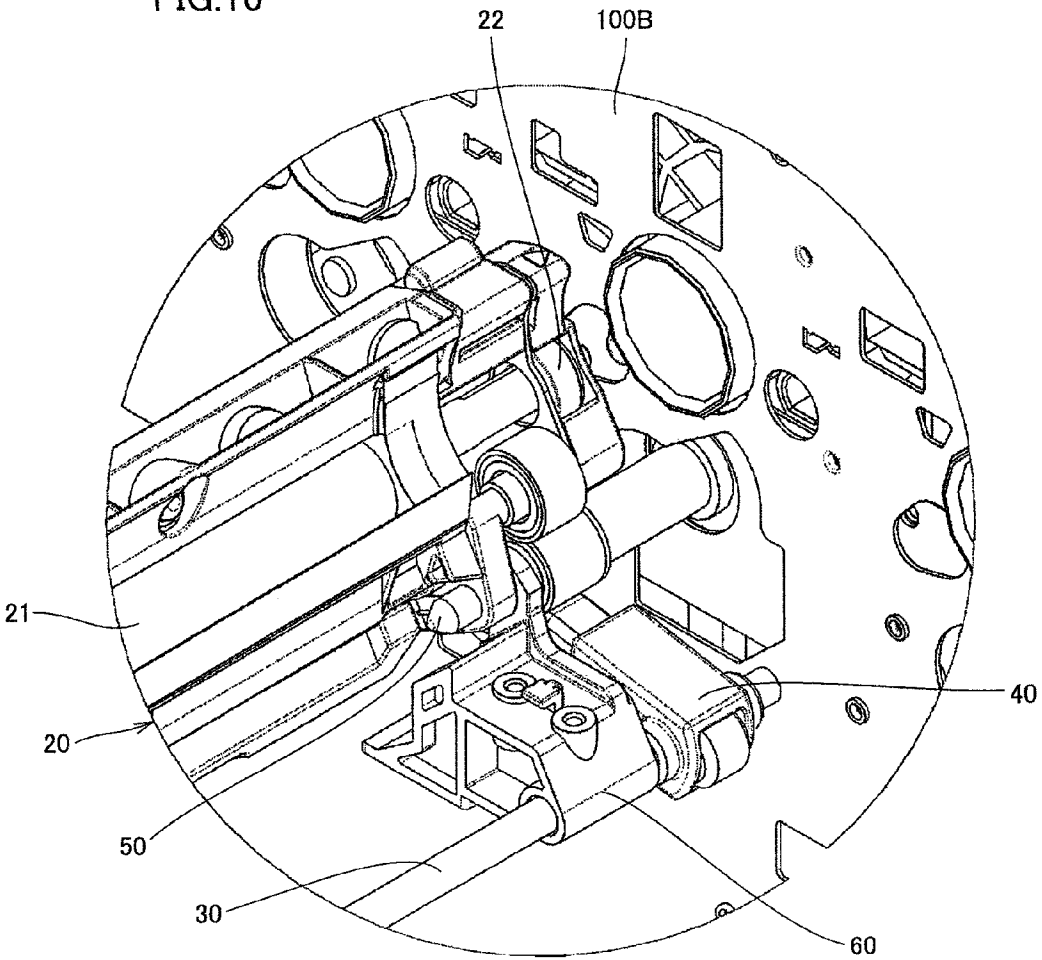
FIGS. 10 and 11 are illustrative diagrams each showing an inclination preventing mechanism provided at a pressing support point in the image forming apparatus according to the embodiment of the present invention.
Figure 11:
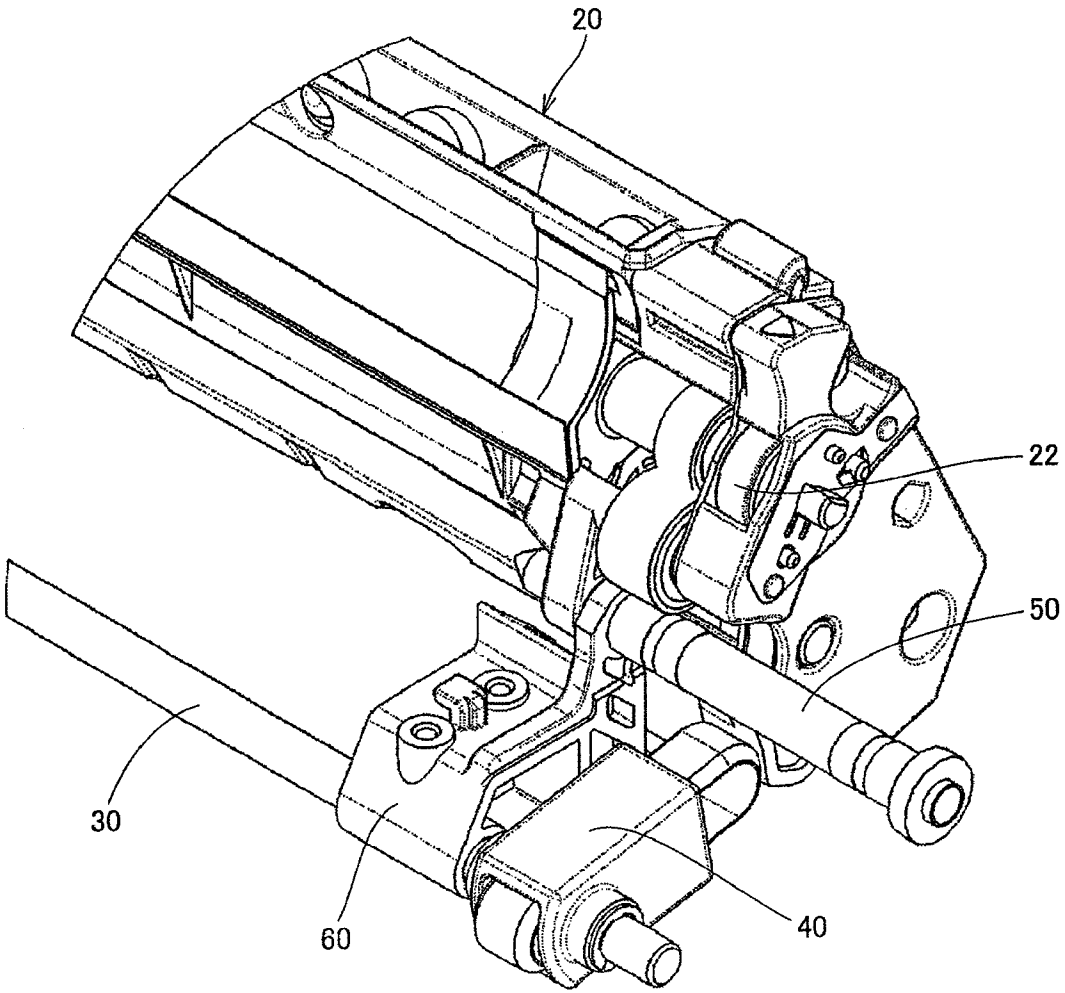

Referring to FIGS. 10 and 11, image forming apparatus 1 is provided with a holding member 60 for holding shaft 30 and shaft 50 together to maintain a fixed interval therebetween. Holding member 60 thus provided prevents the above-described decrease of the force for pressing developing unit 20, thereby maintaining a fixed gap between photoreceptor drum 11 and developing roller 21.

Holding member 60 is provided in a location next to pressing lever 40. Holding member 60 holds shaft 50 at a portion near its tip. In this way, holding member 60 can prevent the inclination of shaft 50 more effectively. In addition, holding member 60 is provided in a location close to a body frame 100B (second frame) positioned at the backside in image forming apparatus 1 (downstream side in the direction in which photoreceptor unit 10 and developing unit 20 are inserted). Pressing lever 40 is positioned between holding member 60 and body frame 100B.

Figure 12:
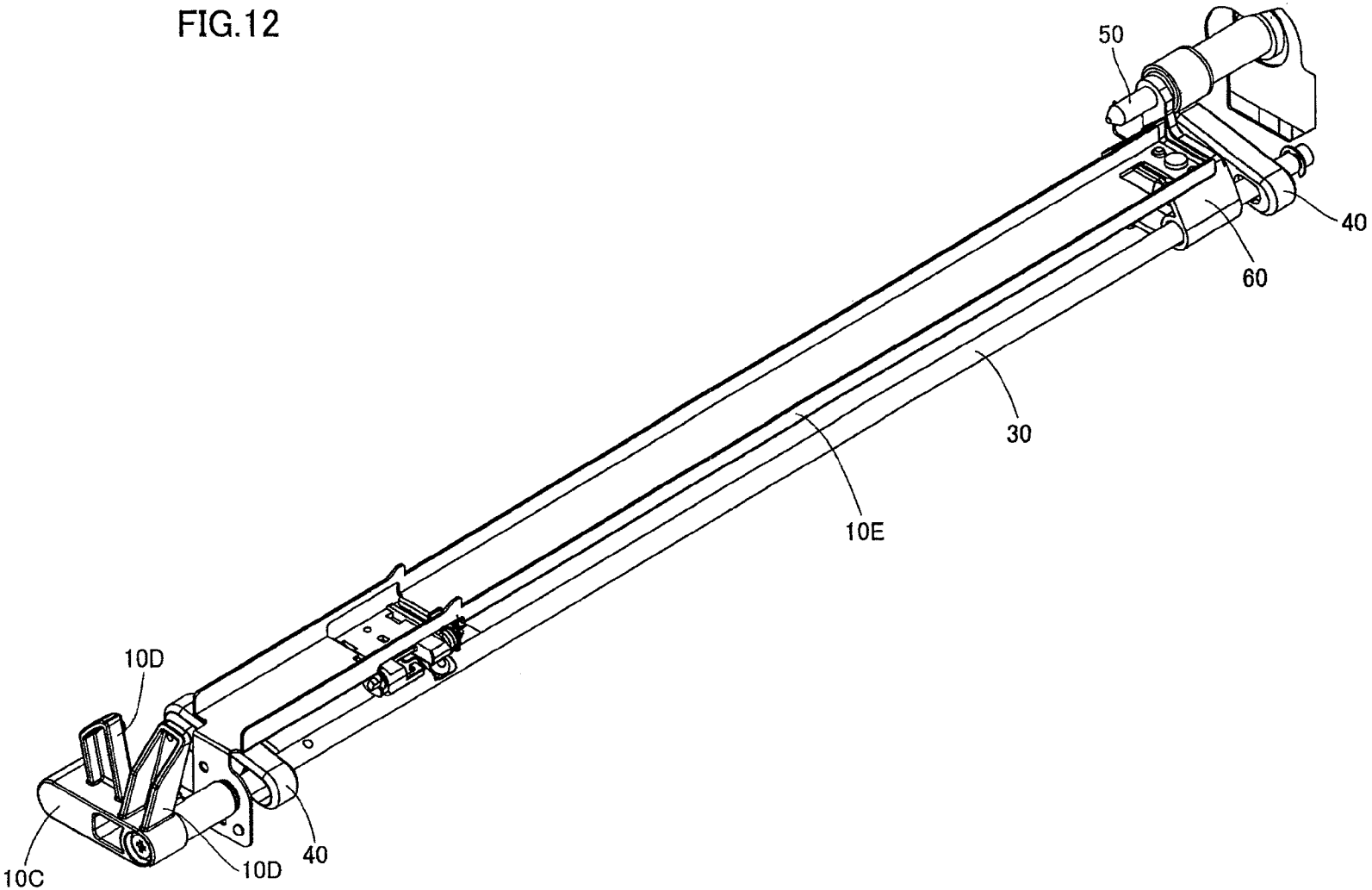
FIG. 12 entirely shows a pressing mechanism in the image forming apparatus according to the embodiment of the present invention.
Figure 13:
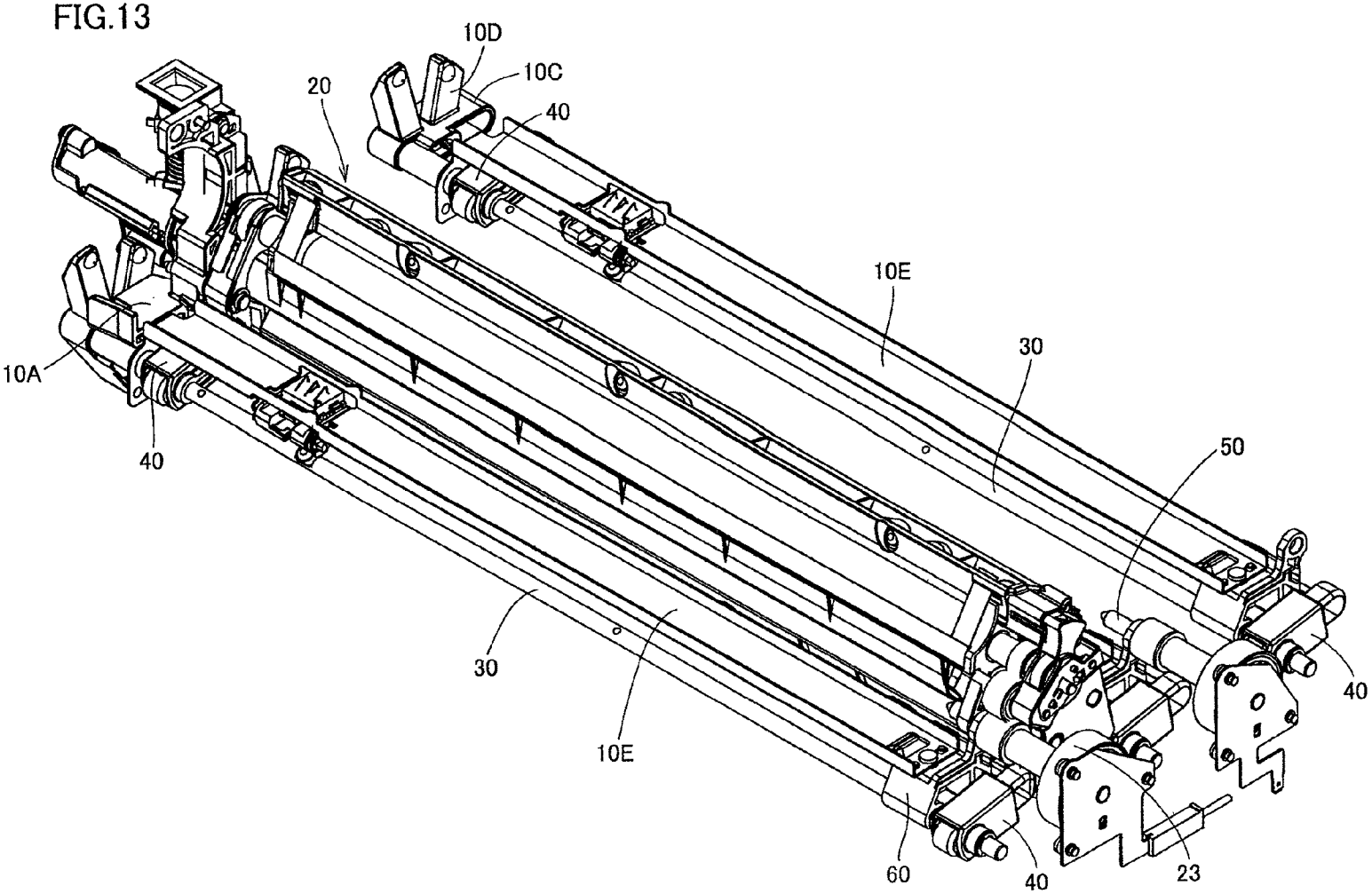
FIG. 13 entirely shows the pressing mechanism and the developing unit in the image forming apparatus according to the embodiment of the present invention.

FIG. 12 entirely shows pressing lever shaft 30 in image forming apparatus 1. FIG. 13 entirely shows pressing lever shaft 30 and developing unit 20 in image forming apparatus 1.

Referring to FIGS. 12 and 13, holding member 60 is only provided at the backside in the front-back direction of image forming apparatus 1 (the upper right side in FIG. 12 and the lower right side in FIG. 13). Also at the backside of image forming apparatus 1, a driving device 23 is provided to drive developing unit 20. In other words, in image forming apparatus 1, holding member 60 is provided only at the side at which driving device 23 for developing unit 20 is provided. In addition, holding member 60 is fixed to body frames 100A, 100B via guide member 10E.

On the other hand, pressing levers 40 are provided at both the front side and the backside in the front-back direction of image forming apparatus 1.

Figure 14:
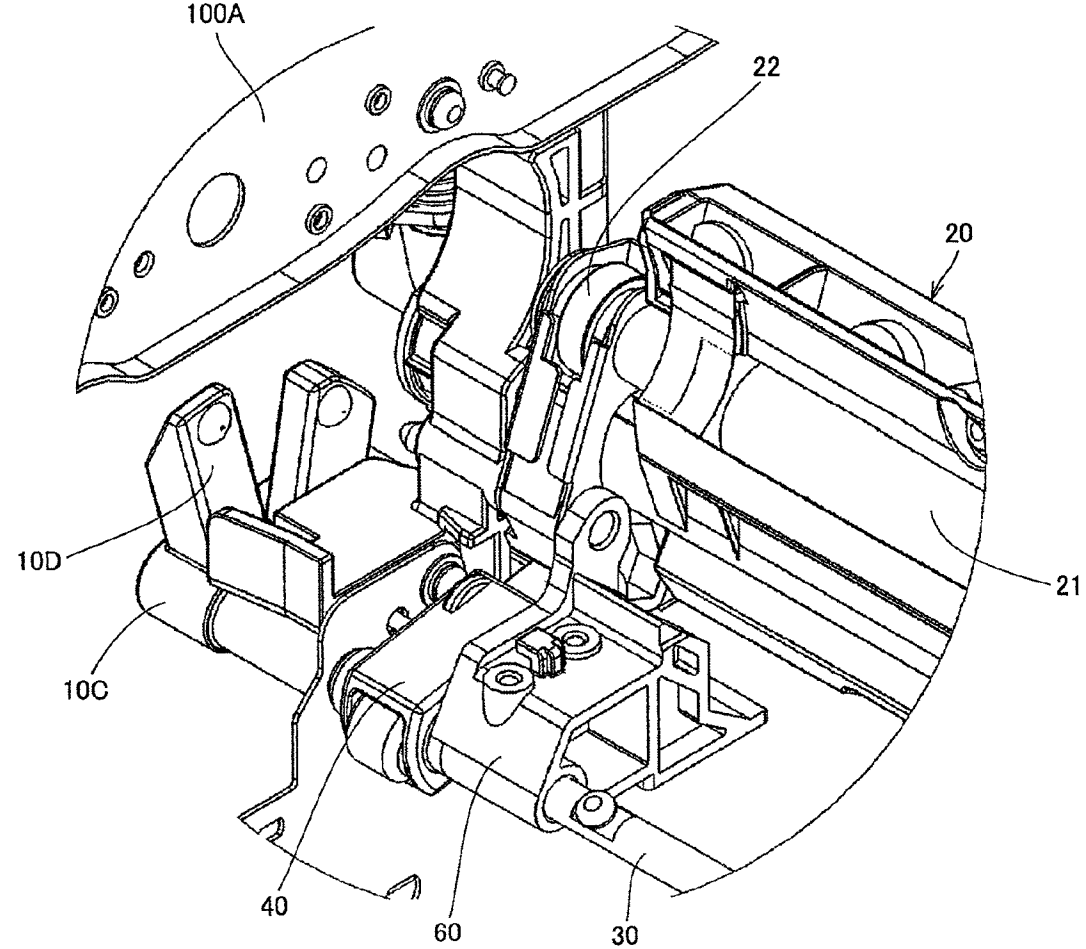
FIG. 14 is an illustrative diagram showing an inclination preventing mechanism for the developing unit in a variation of the image forming apparatus according to the embodiment of the present invention.

Next, with reference to FIG. 14, a variation of image forming apparatus 1 will be described. Referring to FIG. 14, a feature of the present variation lies in that holding member 60 is provided only at the front side of image forming apparatus 1 (location close to body frame 100A). Also in such a case, the decrease of force for pressing developing unit 20 against photoreceptor unit 10 is avoided, thus preventing occurrence of the problems such as decreased image density and uneven density.

As such, according to image forming apparatus 1 according to the present embodiment, holding member 60 provided to hold developing unit supporting shaft 50 and pressing lever shaft 30 allows a fixed distance to be maintained between shafts 30, 50. This achieves a more accurate gap between photoreceptor drum 11 and developing roller 21.

It should be noted that the present embodiment illustrates an example in which holding member 60 is provided at the location next to pressing lever 40, but holding member 60 may be provided at a location distant away from pressing lever 40.

In addition, the present embodiment illustrates an example in which holding member 60 is fixed to body frames 100A, 100B, but holding member 60 may not be fixed to the body frames as long as it serves to maintain a fixed distance between shafts 30, 50.

Further, the present embodiment illustrates an example in which one end of shaft 50 is a free end, but shaft 50 is not limited to this form.

Furthermore, the present embodiment illustrates an example in which pressing levers 40 are provided at both the front side and the backside in the front-back direction of image forming apparatus 1, but pressing levers 40 are not limited to this form. A pressing lever 40 may be provided at one location.

The description above can be summarized as follows. That is, an image forming apparatus according to the present embodiment includes: a photoreceptor unit 10 having a photoreceptor drum 11 on which an electrostatic latent image is formed; a developing unit 20 for developing the electrostatic latent image formed on photoreceptor drum 11; a developing unit supporting shaft 50, which serves as a "first shaft" for rotatably supporting developing unit 20; a pressing lever 40, which serves as a "lever member" for pushing and rotating developing unit 20 to press developing unit 20 against photoreceptor unit 10; a pressing lever shaft 30, which serves as a rotatable "second shaft" for supporting pressing lever 40; and a holding member 60 for holding developing unit supporting shaft 50 and pressing lever shaft 30 to maintain a fixed distance between developing unit supporting shaft 50 and pressing lever shaft 30.

Although the present invention has been described and illustrated in detail, it is clearly understood that the same is by way of illustration and example only and is not to be taken by way of limitation, the scope of the present invention being interpreted by the terms of the appended claims.

What is claimed is:

1. An image forming apparatus comprising:

a photoreceptor unit having a photoreceptor drum on which an electrostatic latent image is formed;

a developing unit for developing said electrostatic latent image formed on said photoreceptor drum;

a first shaft for rotatably supporting said developing unit;

a lever member for pushing and rotating said developing unit to press said developing unit against said photoreceptor unit;

a rotatable second shaft for supporting said lever member;

a body frame for holding said first shaft and said second shaft; and a holding member for holding said first shaft and a part of said second shaft different from a portion held by said body frame to maintain a fixed distance between said first shaft and said second shaft.

2. The image forming apparatus according to claim 1, wherein said holding member is provided in a location next to said lever member.

3. The image forming apparatus according to claim 1, wherein said holding member is fixed to said body frame.

4. The image forming apparatus according to claim 1, wherein one end of said first shaft is a free end.

5. The image forming apparatus according to claim 1, wherein said holding member is provided only at a side at which a driving device for said developing unit is provided.

6. An image forming apparatus comprising:

a photoreceptor unit having a photoreceptor drum on which an electrostatic latent image is formed;

a developing unit for developing said electrostatic latent image formed on said photoreceptor drum;

a first shaft for rotatably supporting said developing unit;

a lever member for pushing and rotating said developing unit to press said developing unit against said photoreceptor unit;

a rotatable second shaft for supporting said lever member;

a holding member for holding said first shaft and said second shaft to maintain a fixed distance between said first shaft and said second shaft; and a pushing unit, which is attached to said second shaft and is capable of pushing said photoreceptor unit in an axial direction, wherein said lever member pushes and presses said developing unit against said photoreceptor unit in conjunction with said pushing unit pushing said photoreceptor unit.

7. An image forming apparatus comprising:

a body frame having a first frame and a second frame;

a photoreceptor unit having a photoreceptor drum on which an electrostatic latent image is formed;

a developing unit, inserted into said body frame in a direction from said first frame toward said second frame and positioned next to said photoreceptor unit, for developing said electrostatic latent image formed on said photoreceptor drum;

a first shaft, having one end fixed to said second frame and the other end that is a free end, and engaged with said developing unit inserted into said body frame, for rotatably supporting said developing unit;

a second shaft, extending in the direction from said first frame toward said second frame and provided rotatably on said body frame;

a lever member, fixed to said second shaft, for pushing said developing unit toward said photoreceptor unit in response to rotation of said second shaft; and a holding member for connecting said first shaft and said second shaft to hold said first shaft and a part of said second shaft different from a portion held by said body frame, said lever member being positioned between said holding member and said second frame.

8. An image forming apparatus comprising:

a body frame having a first frame and a second frame;

a photoreceptor unit having a photoreceptor drum on which an electrostatic latent image is formed;

a developing unit, inserted into said body frame in a direction from said first frame toward said second frame and positioned next to said photoreceptor unit, for developing said electrostatic latent image formed on said photoreceptor drum;

a first shaft, having one end fixed to said second frame and the other end that is a free end, and engaged with said developing unit inserted into said body frame, for rotatably supporting said developing unit;

a second shaft, extending in the direction from said first frame toward said second frame and provided rotatably on said body frame;

a pressing lever member fixed to said second shaft for pushing said developing unit toward said photoreceptor unit in response to rotation of said second shaft; and a holding member for connecting said first shaft and said second shaft, said pressing lever member being positioned between said holding member and said second frame, wherein:

said photoreceptor unit is detachably inserted into said body frame in the direction from said first frame toward said second frame, and in the direction in which said photoreceptor unit is inserted, an attaching lever unit, which is rotatable with said second shaft, is provided at an end of said second shaft closer to said first frame, said attaching lever unit pushes said photoreceptor unit and fixes a position thereof in the direction in which said photoreceptor unit is inserted, by rotating said attaching lever unit.

* * * * *